US007922021B2

(12) United States Patent
Golden

(10) Patent No.: US 7,922,021 B2
(45) Date of Patent: Apr. 12, 2011

(54) CLOSURE FOR A FOOD CONTAINER AND METHOD FOR USING THE SAME

(75) Inventor: Craig A. Golden, Powell, OH (US)

(73) Assignee: Pactiv Corporation, Lake Forest, IL (US)

( * ) Notice: Subject to any disclaimer, the term of this patent is extended or adjusted under 35 U.S.C. 154(b) by 678 days.

(21) Appl. No.: 10/840,728

(22) Filed: May 6, 2004

(65) Prior Publication Data

US 2005/0247708 A1 Nov. 10, 2005

(51) Int. Cl.
*B65D 6/28* (2006.01)
*B65D 8/18* (2006.01)
*B65D 43/14* (2006.01)

(52) U.S. Cl. ..... 220/4.22; 220/4.21; 220/833

(58) Field of Classification Search ..... 220/4.21, 220/833, 375; 215/306; 229/406
See application file for complete search history.

(56) References Cited

U.S. PATENT DOCUMENTS 1,249,096 A 12/1917 Hulme
2,773,624 A 12/1956 Knieriem et al.
3,344,974 A 10/1967 Bostrom
3,420,431 A 1/1969 Donovan
D214,132 S 5/1969 Niemoller
3,460,711 A 8/1969 Al-Roy
3,632,016 A 1/1972 Bozek
3,675,811 A 7/1972 Artz
3,986,627 A * 10/1976 Zapp ..... 215/237
4,061,241 A 12/1977 Retelny
4,206,845 A 6/1980 Christian
D255,857 S 7/1980 Zimmermann
D256,308 S 8/1980 Zimmermann
D256,646 S 9/1980 Painter et al.
4,240,575 A 12/1980 Tange
4,262,815 A 4/1981 Klein
D259,543 S 6/1981 Commisso et al.
4,273,249 A 6/1981 Florian
D259,774 S 7/1981 Criscitiello, Jr.
4,298,133 A 11/1981 Davis
4,298,156 A 11/1981 Reifers et al.
D262,866 S 2/1982 Commisso
D262,944 S 2/1982 Commisso
D263,023 S 2/1982 Commisso
4,375,862 A 3/1983 Kurinsky et al.
4,383,638 A 5/1983 Bixler
D269,323 S 6/1983 Cillario
D269,854 S 7/1983 Commisso
4,396,147 A 8/1983 Jackson
D272,595 S 2/1984 Chase et al.
D273,844 S 5/1984 Bixler et al.
(Continued)

*Primary Examiner* — Anthony Stashick
*Assistant Examiner* — Shawn M Braden
(74) *Attorney, Agent, or Firm* — Baker Botts LLP

(57) ABSTRACT

A closure for a container comprises a base and a top cover. The base comprises a flange trap, a seal lock, and an opening. The top cover comprises a seal boss, a seal lock, a flange boss, and a top surface. The flange trap and flange boss secure the closure to a container when the closure is in a closed position. The seal locks are positioned to engage one another when the closure is in the closed position. The seal boss extends into the container when the closure is in the closed position to help prevent sauce or other liquid from leaking out of the container. A method for using a closure for a container and a container combination provides a closure and a container and arranges the closure so that the container is within the opening of the closure.

26 Claims, 12 Drawing Sheets

U.S. PATENT DOCUMENTS

D274,790 S 7/1984 Bixler et al.
4,463,894 A 8/1984 Daines
D276,216 S 11/1984 Michaud
4,492,331 A 1/1985 Bixler et al.
D281,042 S 10/1985 Antoni et al.
D282,147 S 1/1986 Mangla
4,582,248 A 4/1986 Bixler et al.
4,625,905 A 12/1986 Mangla
4,653,685 A 3/1987 Leasy et al.
D290,232 S 6/1987 Holzkopf et al.
D291,533 S 8/1987 Mangla
4,715,529 A 12/1987 Bixler
4,741,452 A 5/1988 Holzkopf
4,742,934 A 5/1988 Michaud et al.
4,742,952 A 5/1988 Bixler et al.
4,753,351 A 6/1988 Guillin
4,771,934 A 9/1988 Kalmanides
D298,000 S 10/1988 Ritman
D298,304 S 11/1988 Meyer
4,844,263 A 7/1989 Hadtke
4,863,054 A * 9/1989 Capetta ..... 220/4.23
4,874,083 A 10/1989 Antoni et al.
D305,409 S 1/1990 Michaud et al.
4,947,993 A 8/1990 Bruml et al.
4,974,738 A 12/1990 Kidd et al.
5,018,624 A 5/1991 Arneson et al.
D317,671 S 6/1991 Skaggs et al.
5,046,659 A 9/1991 Warburton
5,048,707 A 9/1991 Hallberg
5,065,889 A 11/1991 Conti
5,094,355 A 3/1992 Clark et al.
5,220,999 A 6/1993 Goulette
D340,882 S 11/1993 Holtkamp, Jr.
D341,316 S 11/1993 Fritz et al.
5,266,763 A 11/1993 Colombo
5,269,430 A 12/1993 Schlaupitz et al.
5,287,959 A 2/1994 Hansen et al.
5,300,748 A 4/1994 Colombo
5,322,182 A 6/1994 Fritz
D352,000 S 11/1994 Hansen et al.
D353,327 S 12/1994 Castner et al.
5,377,860 A * 1/1995 Littlejohn et al. ..... 220/784
D358,091 S 5/1995 Warburton
5,423,453 A 6/1995 Fritz
5,429,833 A 7/1995 Wyslotsky
5,460,286 A 10/1995 Rush et al.
5,474,199 A * 12/1995 Julius et al. ..... 220/837
5,515,993 A 5/1996 McManus
5,518,133 A 5/1996 Hayes et al.
D375,683 S 11/1996 Schoff
5,577,627 A 11/1996 Richie-Dubler
D377,580 S 1/1997 Hayes et al.
5,595,769 A 1/1997 Castner et al.
D378,180 S 2/1997 Hayes et al.
5,607,709 A 3/1997 Fritz et al.
5,758,794 A * 6/1998 Rider et al. ..... 220/523
5,772,070 A 6/1998 Hayes et al.
5,860,530 A 1/1999 Simmons et al.
5,984,130 A 11/1999 Hayes et al.
2004/0056040 A1 * 3/2004 Ziegler ..... 220/847

* cited by examiner

CLOSURE FOR A FOOD CONTAINER AND METHOD FOR USING THE SAME

FIELD OF THE INVENTION

The present invention relates generally to a food container and more specifically is directed to a locking lid or closure for a container.

BACKGROUND OF THE INVENTION

Food products such as restaurant and grocery store carry out are transported in various food containers. One type of container is a paperboard container. Some paperboard containers allow for storage, transportation, and preparation of food. For example, paperboard containers may be provided with plastic covers for storage and transportation of food products. Standard plastic covers—such as oriented polystyrene covers—for such containers are dependent upon the dimensions of the container for their effectiveness. These OPS dome closures may be provided with compound skirts having undercuts for interference locking with the container's flange. In such a container-and-closure combination, a single cover may be adapted for use with a single size of container, and these closures are very sensitive to the top outside dimensions of the container to be covered. Additionally, such closures are sensitive to the top outside shape of the container to be covered. Further, such container-and-closure combinations provide an inadequate seal against the flow of liquids out of the container. Other container covers currently utilized include plastic heat seal films and aluminum foil wraps. However, these container cover types present several challenges including, the need for special equipment, a lack of puncture resistance, a lack of tolerance to dimensional variation, and dubious sealing qualities against the flow of liquids.

An example of a typical prior art paper board container is shown in FIG. 1. The container or tray 10 of FIG. 1 has a bottom 12 from which side walls 14 extend upwardly, terminating at a flange 16. The flange 16 of the tray 10 extends outwardly from the tops of the side walls 14 in a direction approximately parallel to the bottom 12 of the tray 10.

The tray 10 is a paperboard tray, formed from a pressed sheet of paperboard and provided with creases 18 where the paperboard has been compressed into a rectangular shape forming the basin 20 of the tray.

Trays such as the tray 10 may be formed with sharp or rounded corners, and the corners may be formed by gathering pleats, or folding a number of scores. The side walls 14 of the tray 10 are at an angle to the bottom 12 of the tray. This type of construction provides a certain amount of variation of the top outside dimensions (i.e., the width W and the length L of the tray at the outermost reaches of the flange 16). The variation in the top outside dimensions is largely a function of changes in the angles of the side walls 14. For example, for paperboard scored and formed into a food container, in some cases the resultant variation in the top outside dimensions can be as much as +/−3/32 of an inch between two different trays. This dimensional variation makes the fit and lock of a formed lid difficult, because such a lid is generally designed for use with trays falling within a much smaller dimensional variation. Further, formed containers using pleats to form the corners are subject to reduced rigidity, because the pleats become pivot points allowing increased flexibility of the food container. The reduced rigidity also presents formed closure fit and lock difficulties.

It is desirable for a container closure or lid to have greater tolerance for use with trays of different dimensions. Further, it is desirable for a container closure or lid to proved a more complete seal against the flow of liquids from the container. Finally, it is preferable for such a container-and-lid combination to be convenient and easy to use. The present invention is directed to an improved closure or lid and to containers employing improved closures or lids.

SUMMARY OF THE INVENTION

According to one embodiment of the present invention, a closure for a container comprises a base, and a top cover. The base has a flange trap, a base seal lock, and an opening. The flange trap has a generally horizontal orientation, and the opening is located inside of the flange trap. According to this embodiment, the base seal lock extends beyond the flange trap. The top cover has a seal boss, a top cover seal lock, a flange boss, and a top surface. The top cover seal lock is disposed to align with and contact the base seal lock when the closure is in a closed position. The flange boss is located inside of the top cover seal lock and is disposed to align with the flange trap when the closure is in the closed position. The seal boss is located inside of the top cover seal lock and the flange boss and extends beyond the top cover seal lock and the flange boss, such that the seal boss extends into the base when the closure is in the closed position.

According to another embodiment of the present invention, a container and closure combination is provided. The container has a bottom, at least one side wall, and a flange. The at least one side wall joins the bottom to the flange. The flange is generally horizontal and extends outwardly around a perimeter of the at least one side wall. The closure for a container comprises a base, a top cover, and a hinge. The base has a flange trap, a base seal lock, and an opening. The flange trap has a generally horizontal orientation, and the opening is located inside of the flange trap. According to this embodiment the base seal lock extends beyond the flange trap. The top cover has a seal boss, a top cover seal lock, a flange boss, and a top surface. The top cover seal lock is disposed to align with and contact the base seal lock when the closure is in a closed position. The flange boss is located inside of the top cover seal lock and is disposed to align with the flange trap when the closure is in the closed position. The seal boss is located inside of the top cover seal lock and the flange boss and extends beyond the top cover seal lock and the flange boss such that the seal boss extends into the base when the closure is in the closed position. The hinge connects the top cover and the base.

According to a further embodiment of the present invention, a closure for a container comprises a base, and a top cover. The base has a flange trap, a base seal lock, at least one base sidewall, and an opening. The flange trap has a generally horizontal orientation. The at least one sidewall is generally identical in shape to the container the closure is used with. The opening is located inside of the flange trap and the at least one sidewall. According to this embodiment the base seal lock extends beyond the flange trap. The top cover has a seal boss, a top cover seal lock, a flange boss, and a top surface. The top cover seal lock is disposed to align with and contact the base seal lock when the closure is in a closed position. The flange boss is located inside of the top cover seal lock and is disposed to align with the flange trap when the closure is in the closed position. The seal boss is located inside of the top cover seal lock and the flange boss and extends beyond the top cover seal lock and the flange boss such that the seal boss extends into the base when the closure is in the closed position.

A method of using a closure for a container and a container combination is also provided according to the present invention. The closure for a container comprises a base, a top cover, and a hinge. The base has a flange trap, a base seal lock, and an opening. The flange trap has a generally horizontal orientation, and the opening is located inside of the flange trap. The base seal lock extends beyond the flange trap. The top cover has a seal boss, a top cover seal lock, a flange boss, and a top surface. The top cover seal lock is disposed to align with and contact the base seal lock when the closure is in a closed position. The flange boss is located inside of the top cover seal lock and is disposed to align with the flange trap when the closure is in the closed position. The seal boss is located inside of the top cover seal lock and the flange boss. The seal boss extends beyond the top cover seal lock and the flange boss such that the seal boss extends into the base when the closure is in the closed position. The hinge connects the top cover and the base. The container has a bottom, at least one side wall, and a flange. The method provides the closure and the container. The method arranges the closure and the container so that the container bottom is within the opening of the closure base. Further, the method positions the closure so that the flange trap of the closure base contacts the container flange. Additionally, the top cover of the closure rotates about the hinge so that the flange boss of the top cover contacts the container flange and the seal boss is within the at least one sidewall of the container. The method secures the top cover of the container to the base so that the top cover seal lock engages the base seal lock.

BRIEF DESCRIPTION OF THE DRAWINGS

Other advantages of the invention will become apparent upon reading the following detailed description and upon reference to the drawings.

Figure 1:
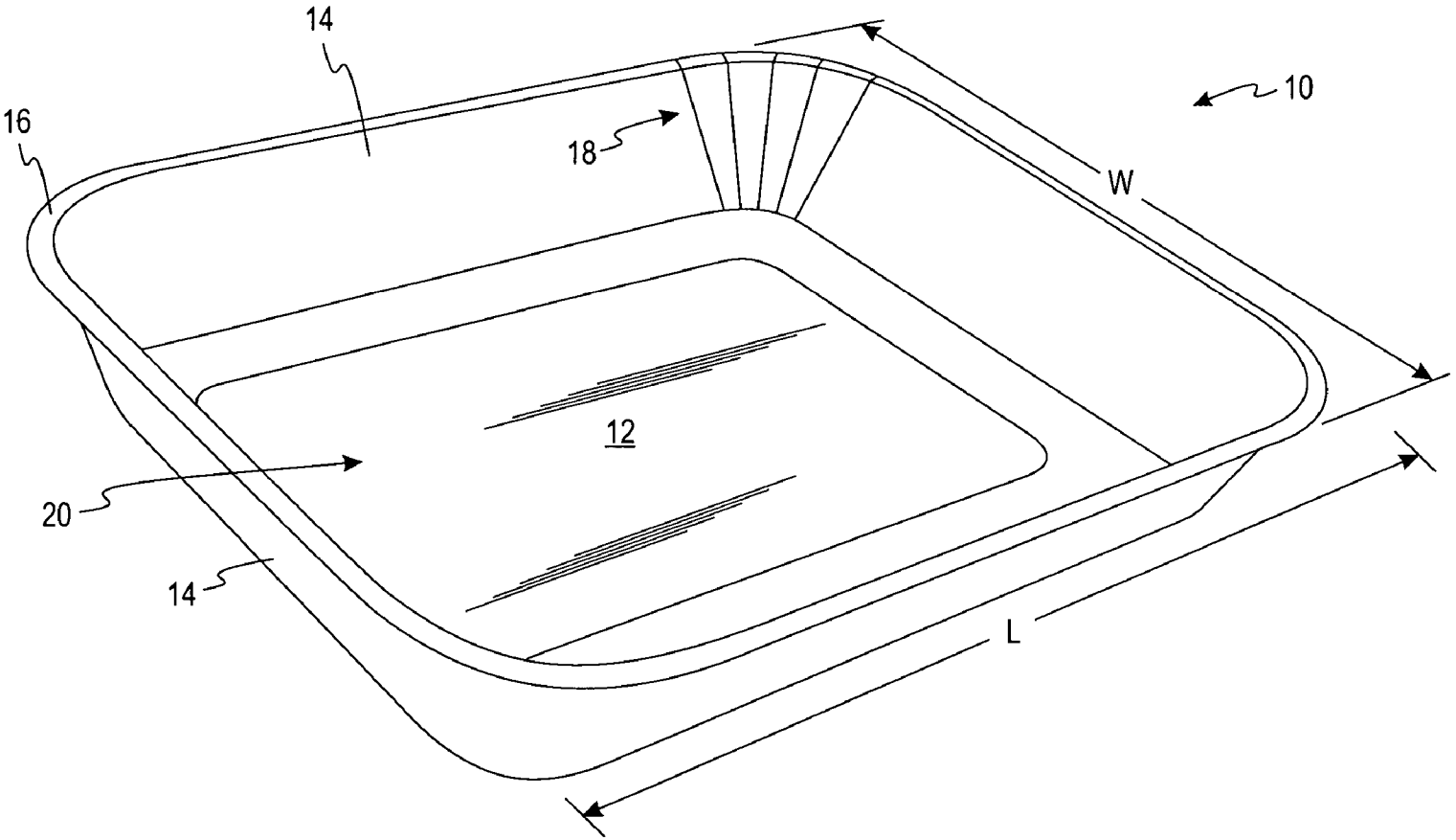
Fig. 1 Prior Art
FIG. 1 is a perspective view of a prior art tray.

While the invention is susceptible to various modifications and alternative forms, specific embodiments thereof have been shown by way of example in the drawings and will herein be described in detail. It should be understood, however, that it is not intended to limit the invention to the particular forms disclosed but, on the contrary, the intention is to cover all modifications, equivalents, and alternatives falling within the spirit and scope of the invention as defined by the appended claims.

DETAILED DESCRIPTION OF THE ILLUSTRATED EMBODIMENT

Figure 2:
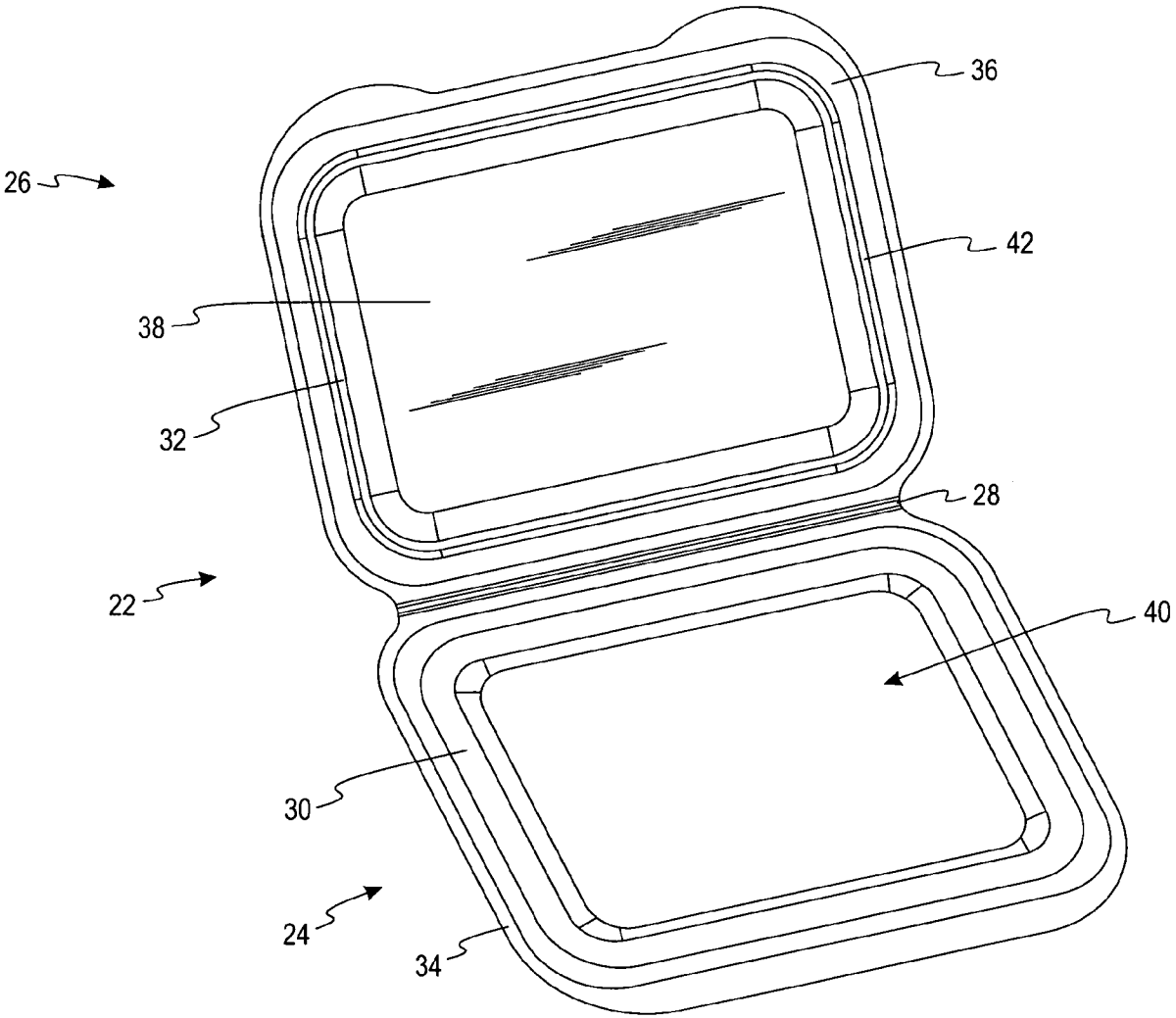
FIG. 2 is a perspective view of a closure in an open position according to one embodiment of the present invention.

Referring now to the drawings, and initially to FIG. 2, the present invention is directed to hinged closures that may be used in combination with a variety of types of containers. One type of hinged closure is a lid 22 for use with the prior art tray 10 (FIG. 1). The lid 22 has a base 24 and a top cover 26 connected to the base 24 along a hinge 28, which allows the top cover 26 to move between open (FIG. 3) and closed (FIG. 4) positions. The base 24 of the lid 22 is provided with a flange trap 30 adapted to contact the flange 16 of the tray 10 from the underside of the flange when the lid 22 is used with the tray 10. The top cover 26 of the lid 22 is provided with a seal boss 32 adapted to extend partially into the basin 20 of the tray 10 and is further described with respect to FIGS. 5 and 6. A bottom seal lock 34 is provided on the base 24 and is adapted to mate with a top seal lock 36 when the lid 22 is in its closed position. A top surface 38 of the top cover 26 extends across the top cover. The top surface 38 may be elevated above the flange 18 of the tray 10 when the lid 22 and tray 10 are assembled, and may be provided with decorative or eye-catching patterns. The top cover 26 of the lid 22 is also provided with a flange boss 42. The flange boss 42 is adapted to contact the flange 16 of the tray 10 when the lid 22 is in its closed position. One type of container that may employ a lid according to the present invention is shown in FIG. 1. The tray 10 of FIG. 1 has a bottom 12 from which side walls 14 extend upwardly, terminating at a flange 16. The flange 16 of the tray 10 extends outwardly from the tops of the side walls 14 in a direction approximately parallel to the bottom 12 of the tray 10.

Figure 3:
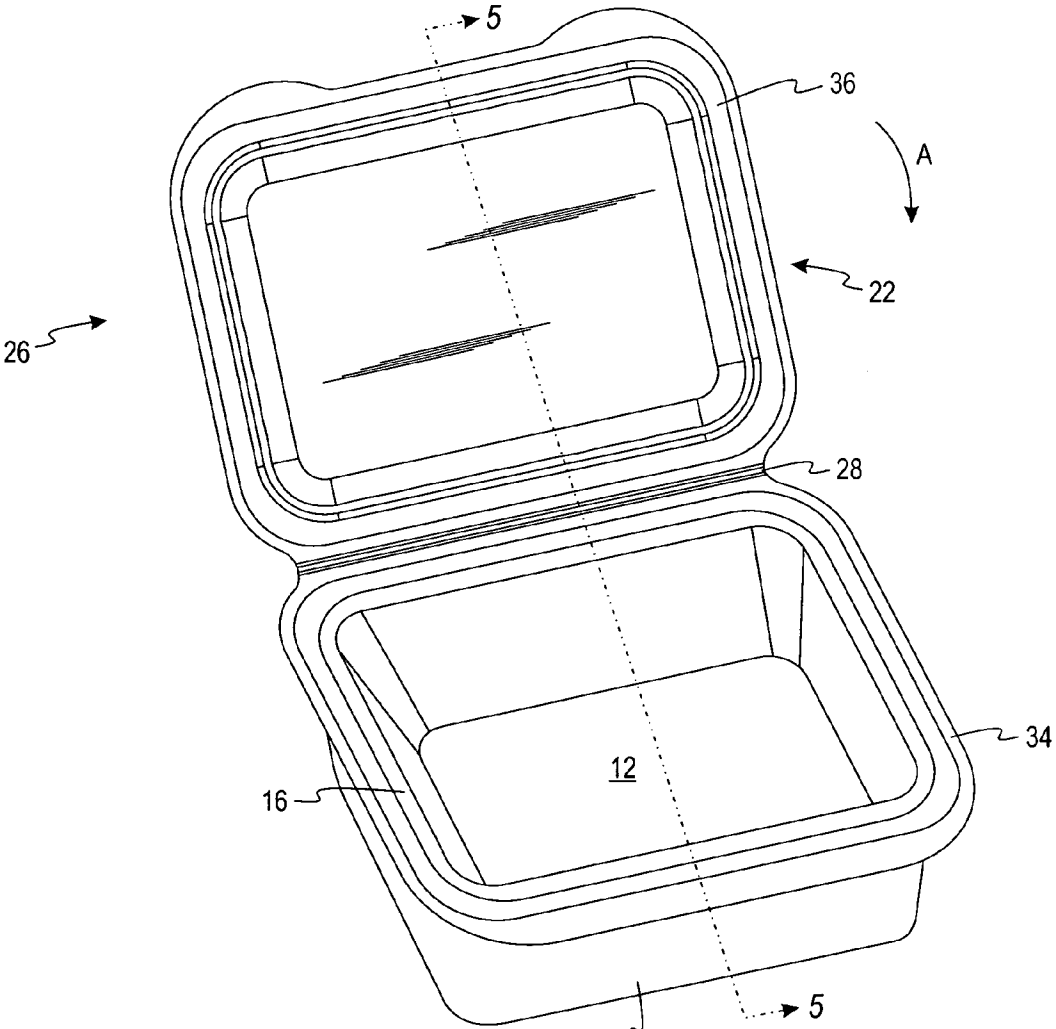
FIG. 3 is a perspective view of the closure of FIG. 2 in an open position and positioned for use with the tray of FIG. 1.

Referring also to FIG. 3, the flange trap 30 of the lid 22 surrounds an opening 40 for accepting a tray 10. In use, the lid 22 is placed on a surface, such as a countertop, and the bottom 12 of the tray 10 is placed through the opening 40. The lid 22 is then lifted upwardly until the flange trap 30 contacts the underside of the flange 16 of the tray, resulting in the arrangement shown in FIG. 3.

Figure 4:
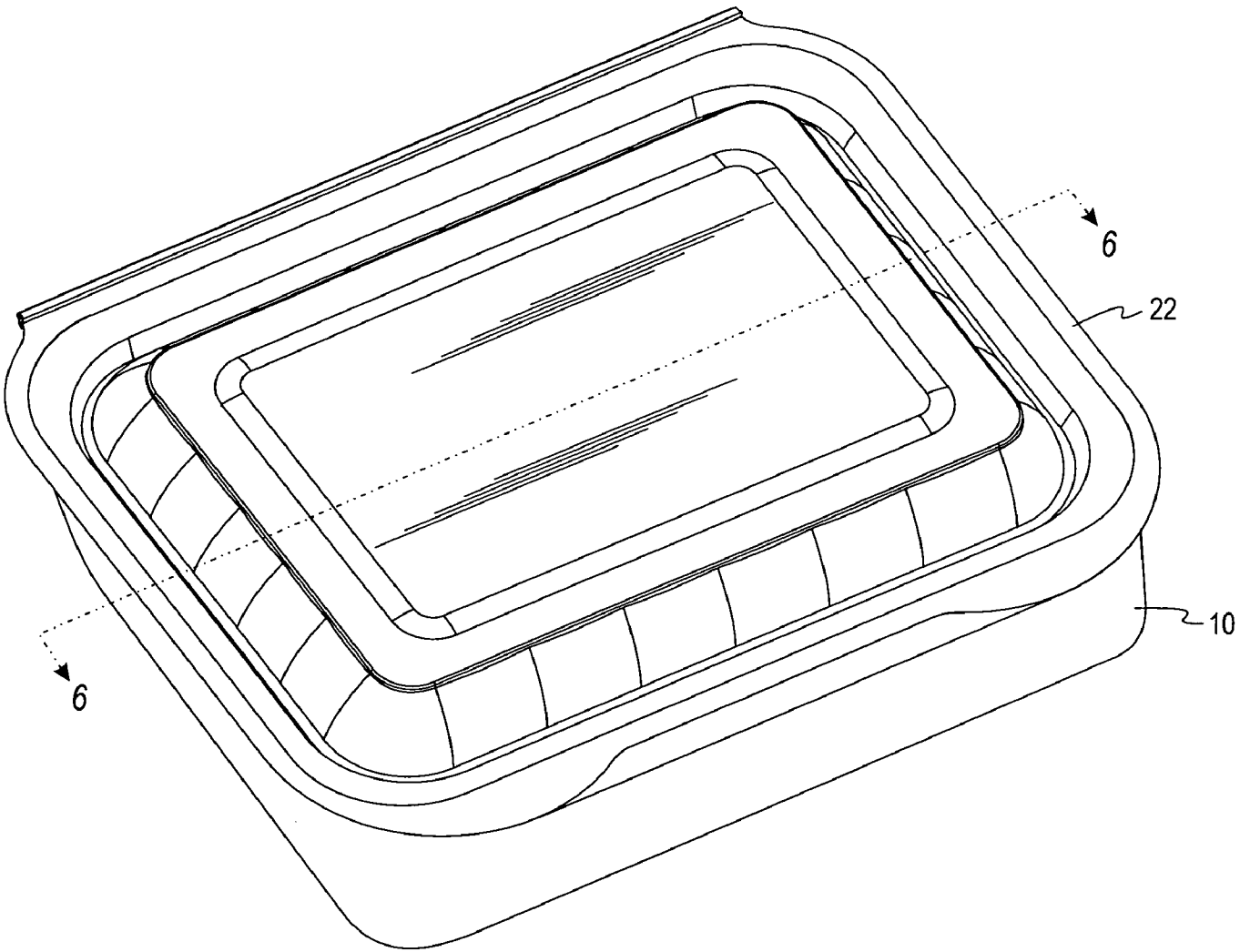
FIG. 4 is a perspective view of the closure of FIG. 2 in a closed position on the tray of FIG. 1.

Next, the top cover 26 is rotated about the hinge 28 in the direction shown by the arrow "A" of FIG. 3, until the top seal lock 36 contacts the bottom seal lock 34. The seal locks are then pressed and locked together, resulting in a closed container, with the tray 10 covered by the lid 22 as shown in FIG. 4.

Figure 5:
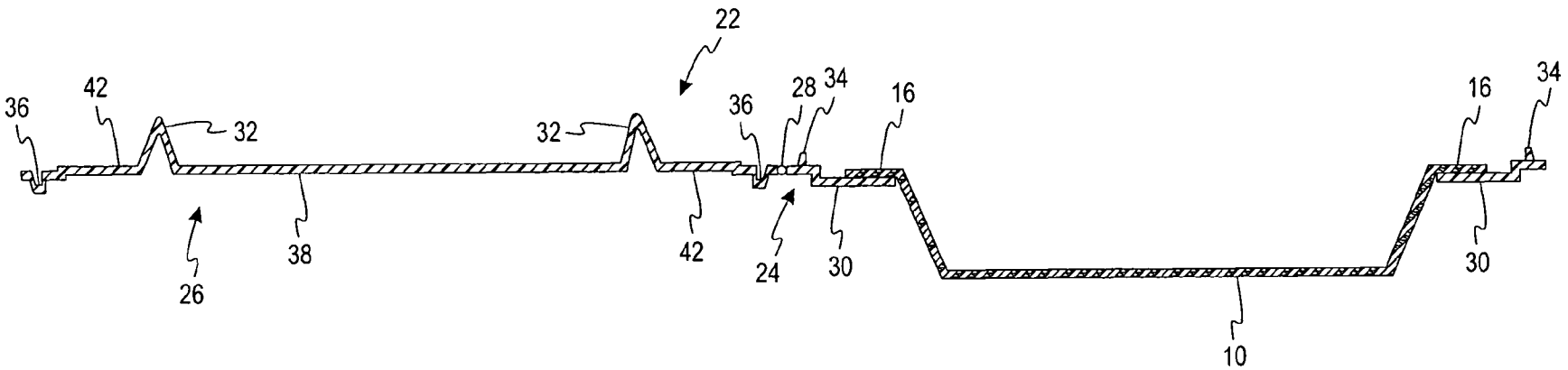
FIG. 5 is a cross-sectional view taken generally along line 5-5 of FIG. 3.

The relationships among the structures of the tray 10 and the lid 22 are described with reference to FIG. 5, which shows a cross-sectional view of the tray 10 and the lid 22 in an open position according to one embodiment of the present invention. The lid 22 is shown with the flange trap 30 in contact with the flange 16 of the tray 10. The flange trap 30 is generally wider than the flange 16 so that the flange trap 30 may receive the flange 16 even when there is dimensional variation of up to +/−3/32 inch between two different trays as described in the background section. As shown in FIG. 5, the flange boss 42 is located between the seal boss 32 and the top seal lock 36. The seal boss 32 extends beyond the top surface 38 of the top cover 26 of the lid 22. According to the embodiment shown in FIG. 5, the top seal lock 36 extends in the opposite direction of the seal boss 32. The hinge 28 connects the base 24 of the lid 22 to the top cover 26 of the lid 22. The bottom seal lock 34 of the base 24 of the lid 22 is positioned outside of the flange trap 30 of the lid 22.

Figure 6:
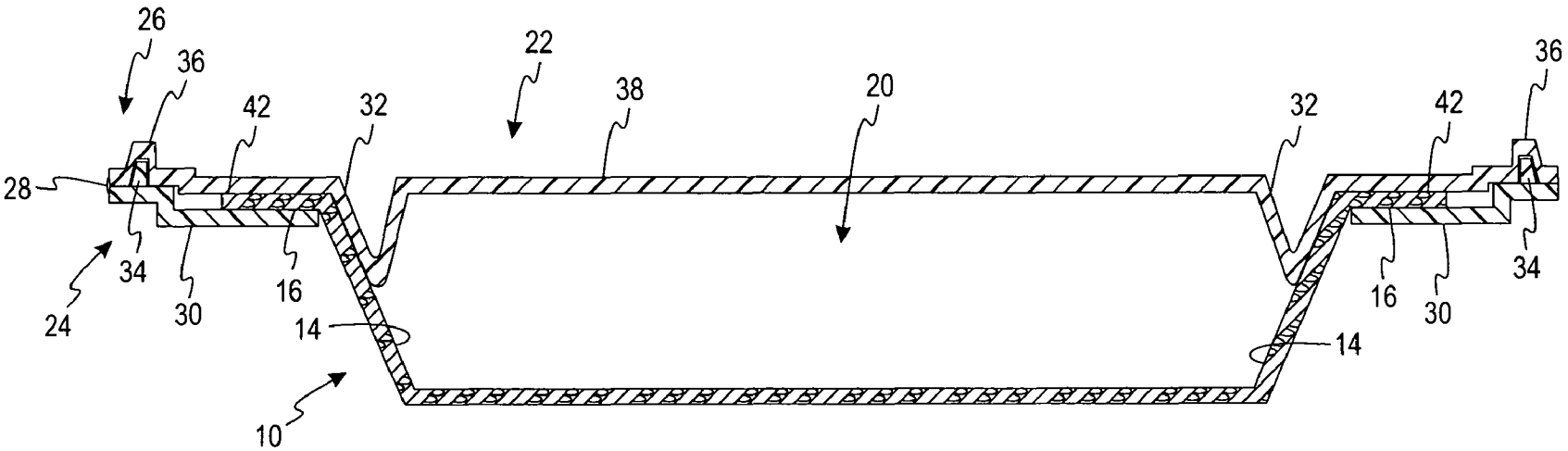
FIG. 6 is a cross-sectional view taken generally along line 6-6 of FIG. 4.

Turning now to FIG. 6, the lid 22 is shown in a closed position on the tray 10. The flange 16 of the tray 10 is secured between the flange trap 30 and the flange boss 42 of the lid 22. The contact between the seal boss 32 and the side walls 14 creates a seal suitable for the retention of sauces and other food liquids within the tray 10 and lid 22 combination.

As shown in FIG. 6, the top cover 26 has rotated about the hinge 28 to come in contact with the base 24 of the lid 22. The top seal lock 36 of the top cover 26 mates with the bottom seal lock 34 of the base 24 of the lid 22, thus closing the lid 22. When the lid 22 is closed, the top surface 38 of the lid 22 covers the basin 20 of the tray 10 and any contents therein. Securing the tray 10 in this manner increases the rigidity of the combination of the tray 10 and the lid 22. The rigidity of the tray 10 and the lid 22 in the closed position is further increased by the seal boss 32 of the lid 22 contacting the side walls 14 of the tray 10 as can be seen in FIG. 6. Additionally, the contact between the seal boss 32 and the side walls 14 applies a force to the side walls 14 making the shape of the container 10 more similar to the shape of the lid 22.

Figure 7:
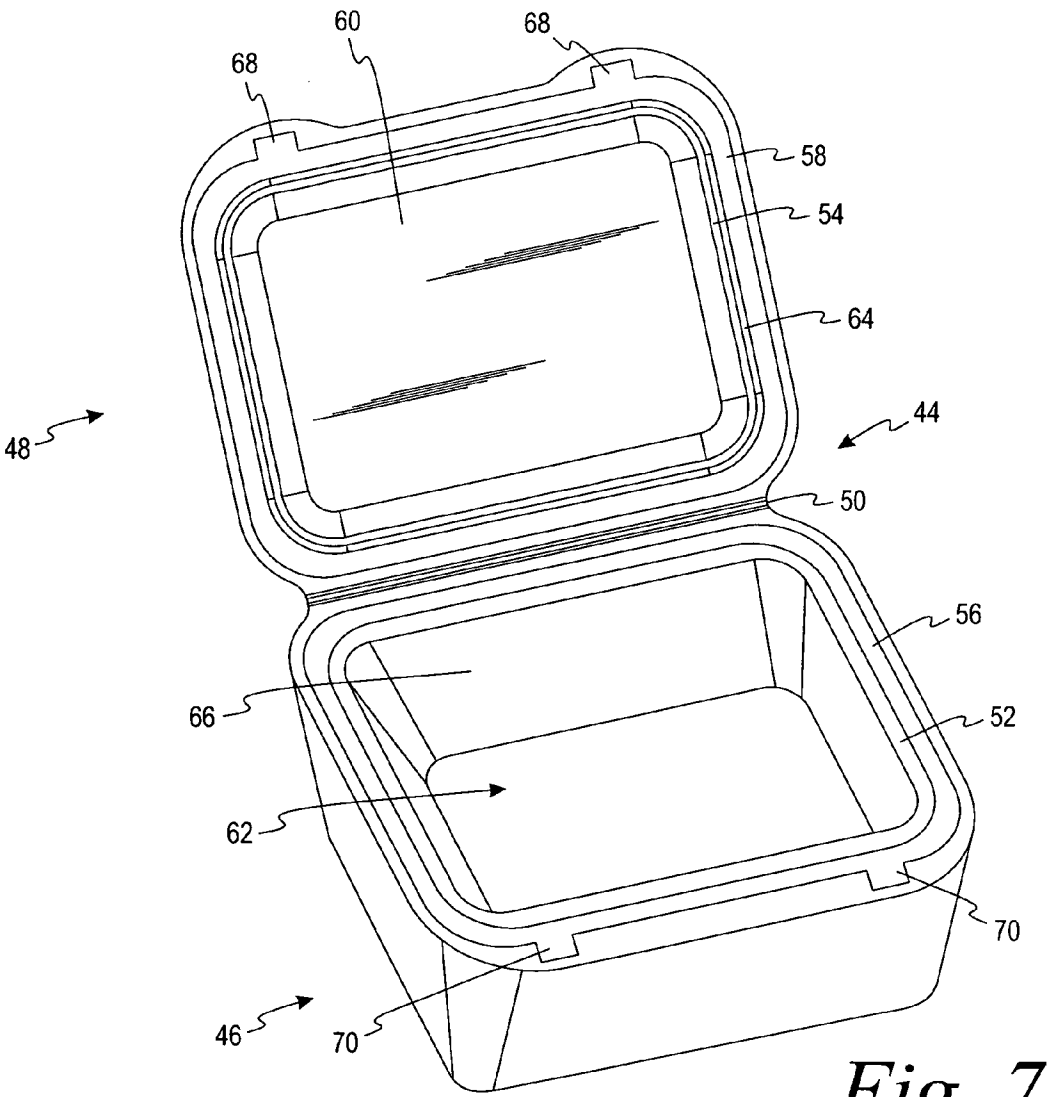
FIG. 7 is a perspective view of a closure in an open position according to a further embodiment of the present invention.

Turning next to FIG. 7, a lid 44 is shown according to another embodiment of the present invention. The lid 44 has a base 46 and a top cover 48. The base 46 and the top cover 48 of the lid 44 are connected via a hinge 50. The base 46 of the lid 44 is similar in shape to the container 10 of FIG. 1. The base 46 has base side walls 66 that extend from a flange trap 52 to an opening 62. The base side walls 66 allow the base 46 of the lid 44 to sit on a surface, such as a tabletop or a counter, in the open position with greater stability than a lid without the side walls 66.

As shown in FIG. 7, the top cover 48 has a seal boss 54, a top seal lock 58, a flange boss 64, a top surface 60, and top cover locks 68. The seal boss 54, top seal lock 58, flange boss 64, and top surface 60 function as described previously in the embodiment shown in FIGS. 2-6. The top cover locks 68 engage with base of lid locks 70 to more securely close the lid 44. In the closed position the top cover locks 68 and the base of lid locks 70 snap together to allow a user to know that the lid 44 is securely closed. Locking mechanisms are described in further detail in U.S. Pat. Nos. 5,758,791; 5,860,530; and 5,979,687.

The base 46 of the lid 44 has a flange trap 52, a bottom seal lock 56, and an opening 62 at the lower end of the side walls 66. The flange trap 52, bottom seal lock 56, and opening 62 function as previously described in the embodiment depicted in FIGS. 2-6.

Figure 8:
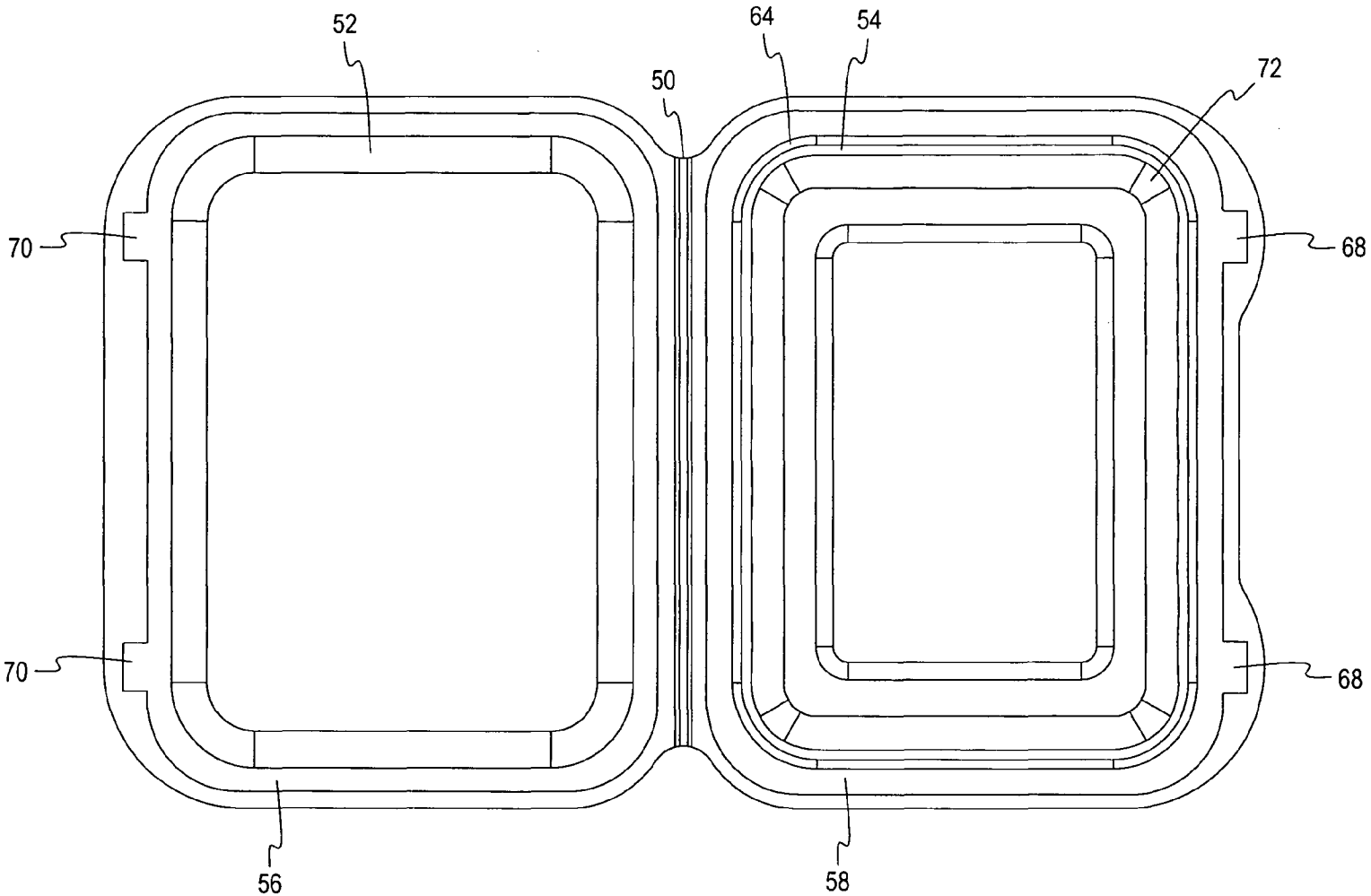
FIG. 8 is a top view of a closure of FIG. 7 in an open position.

FIG. 8 shows a top view of the lid 44 in an open position. The top cover 48 has a plurality of scallops 72 distributed around the perimeter of the top surface 60. The scallops 72 increase the rigidity of the top cover 48 and the lid 44. The relation between base of lid locks 70 and top cover locks 68 can also be seen in FIG. 8.

Figure 9:
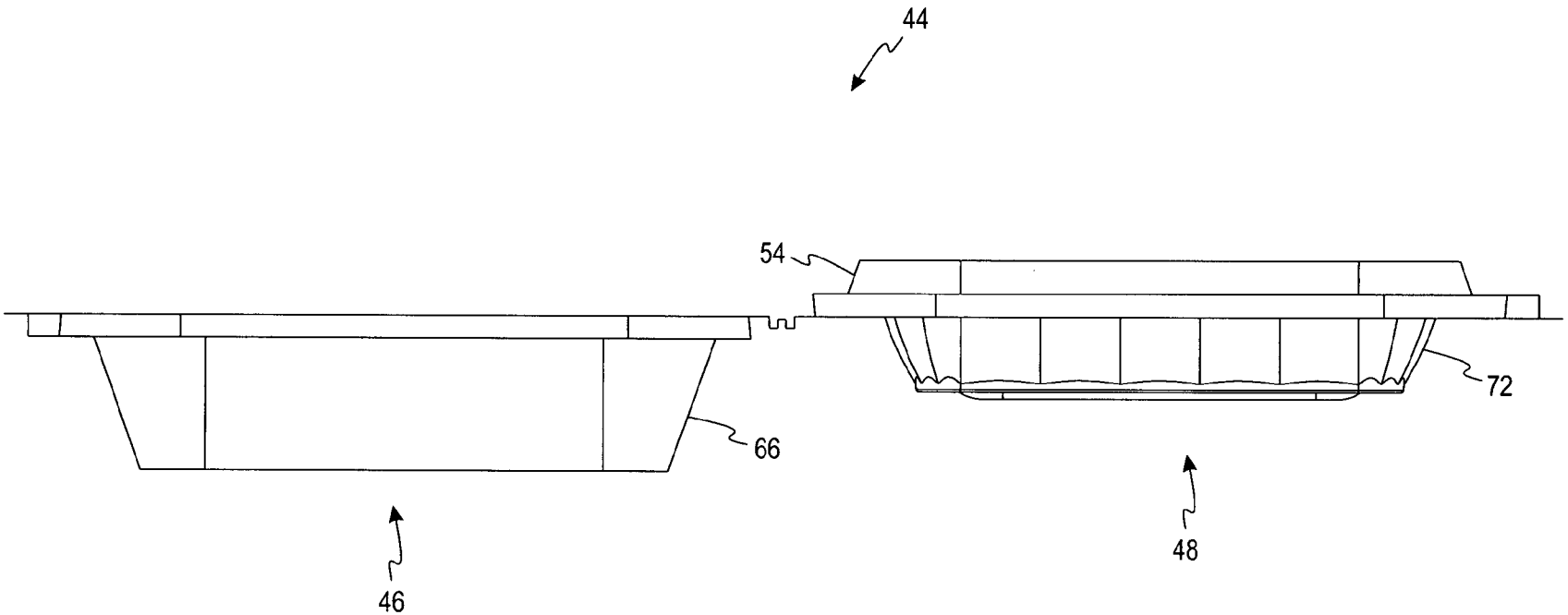
FIG. 9 is a side view of a closure of FIG. 7 in an open position.

As can be seen in FIG. 9, the side walls 66 of the base 46 of the lid 44 have a substantially identical shape to the side walls 14 of the container 10 shown in FIG. 1. This allows the container 10 to be placed within the lid 44, while allowing the base 46 of the lid 44 to sit on a surface, such as a counter or tabletop.

Figure 10:
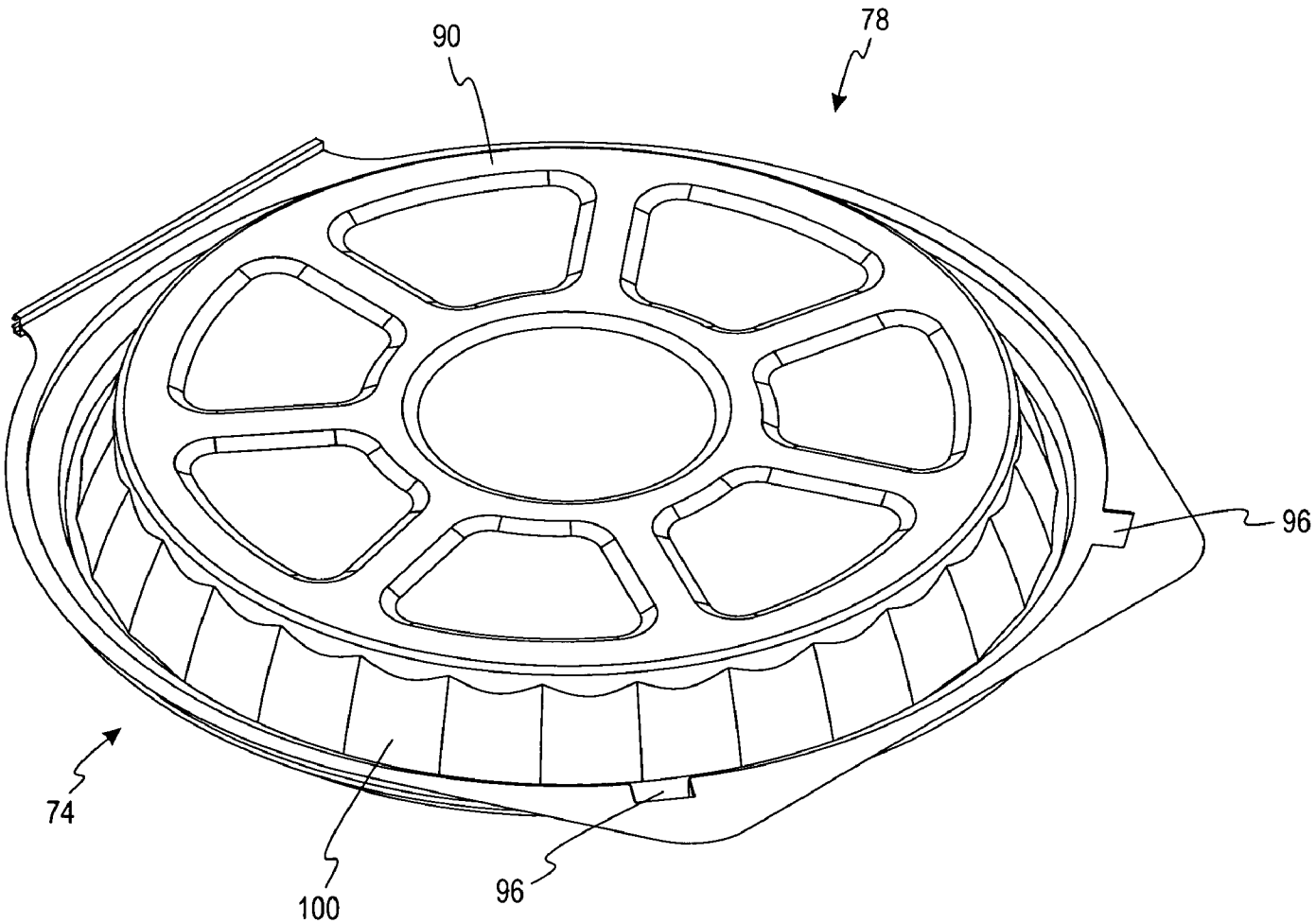
FIG. 10 is a perspective view of a closure in a closed position according to another embodiment of the present invention.

Turning now to yet another embodiment of the present invention, the lid of the present invention may be circular in shape. A circularly shaped lid 74 can be seen in a FIGS. 10-12. The lid 74 is similar to the previously shown lid 22 in many ways. The lid 74 has a top cover 78. The top cover 78 has scallops 100 located along the perimeter of the top cover 78 to increase the rigidity of the top cover 78. The top cover 78 also has a top surface 90, and top cover locks 96.

Figure 11:
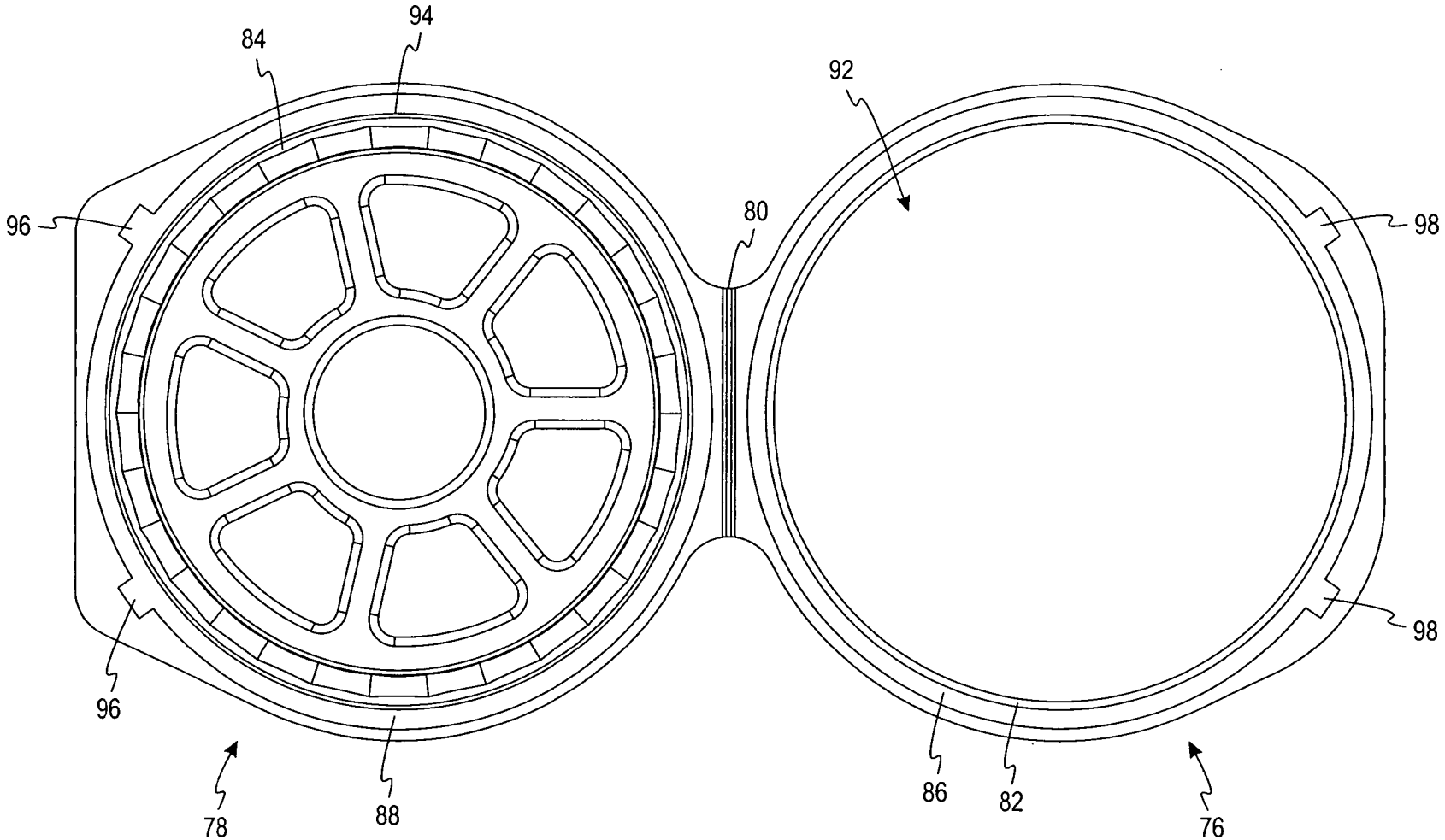
FIG. 11 is a top view of a closure of FIG. 10 in an open position.

FIG. 11 better shows the features of the lid 74. The lid 74 has a base 76 connected to the top cover 78 along a hinge 80. The base 76 has a flange trap 82, a bottom seal lock 86, an opening 92, and base of lid locks 98. The flange trap 82, bottom seal lock 86, and opening 92 function as in the previously described embodiments.

The relationship of certain features of the top cover 78 of the lid 74 also are shown in FIG. 11. The top cover 78 has a seal boss 84, a flange boss 94, a top seal lock 88. The seal boss 84, flange boss 94, and top seal lock 88 function as in the previously described embodiments.

Figure 12:
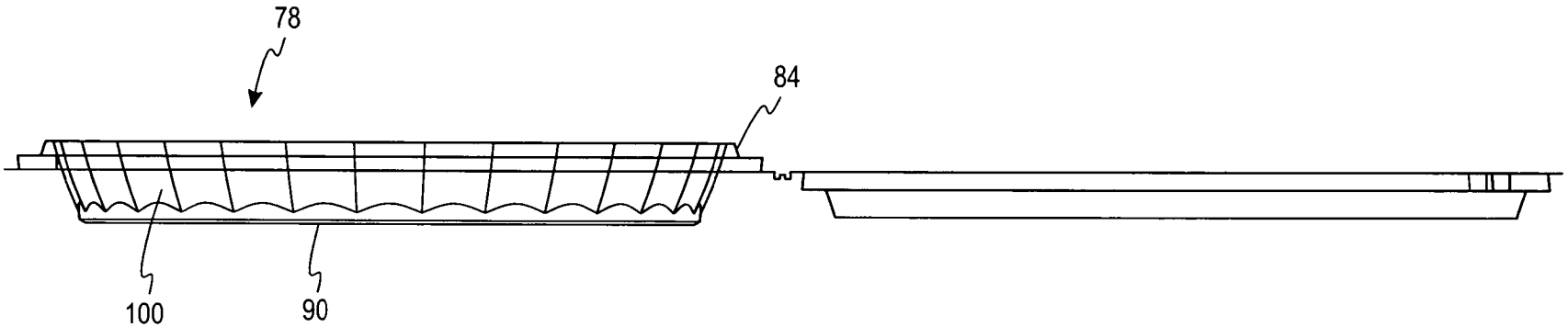
FIG. 12 is a side view of a closure of FIG. 10 in an open position.

As can be seen in FIG. 12, the scallops 100 of the top cover 78 extend from the top surface 90 to the seal boss 84.

The lid may be manufactured using conventional thermoforming techniques. The lid may be composed of a polymeric material such as, but not limited to, oriented polystyrene (OPS), polyethylene terephthalate (PET), polyvinyl chloride (PVC), polypropylene, polyethylene, or any combination thereof.

According to an alternate embodiment of the present invention, the lid may exist in two separate pieces with the base and the top cover comprising the two pieces of the lid.

It is to be understood that while lids and trays having a rectangular shape and a circular shape have been illustrated, lids and trays having different shapes and dimensions may be used according to the principles of the present invention. For example, oval-shaped trays and lids may be used. Further, the principles of the present invention do not apply merely to use of lids with trays, but may also apply to lids for other containers such as cups, bowls, plates, and the like. Further, while lids according to the present invention have been shown in use with trays made of paperboard, it is to be understood that trays made of other materials such as molded pulp, polymeric materials, and metal may be used with lids according to the present invention.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A closure for a container having a bottom, at least one sidewall extending generally upwardly from the bottom, and a substantially planar flange extending generally outwardly from a top of the at least one sidewalls, the closure comprising:

a base having a substantially planar flange trap, a base seal lock, and an opening, the flange trap having a generally horizontal orientation, the opening being defined inside of the flange trap, and the base seal lock extending beyond the flange trap; and a top cover having a seal boss, a top cover seal lock, a substantially planar flange boss, and a top surface, the top cover seal lock being disposed to align with and contact the base seal lock when the closure is in a closed position, the flange boss being located inside of the top cover seal lock and being disposed to align with the flange trap when the closure is in the closed position, the seal boss being located inside of the top cover seal lock and the flange boss and outside the top surface, the seal boss having an open V-shaped configuration defined by first and second members joined at an apex extending downwardly beyond the top surface and the flange boss such that the seal boss extends into the base to contact at least one sidewall of a container positioned in the base when the closure is in the closed position.

2. The closure of claim 1 further comprising a hinge connecting the base to the top cover and allowing the closure to exist in an open position or a closed position.

3. The closure of claim 1, wherein the closure comprises a polymer.

4. The closure of claim 3, wherein the closure comprises oriented polystyrene (OPS).

5. The closure of claim 3, wherein the closure comprises polyethylene terephthalate (PET).

6. The closure of claim 3, wherein the closure comprises polypropylene.

7. A closure and a container combination comprising:

a container having a bottom, at least one side wall, and a substantially planar flange, the at least one side wall joining the bottom to the flange, the flange being generally horizontal and extending around a perimeter of the at least one side wall, the flange extending outwardly from the at least one side wall;

a closure having a base, a top cover, and a hinge;

the base having a substantially planar flange trap, a base seal lock, and an opening, the flange trap having a generally horizontal orientation, the opening being defined inside of the flange trap, and the base seal lock extending beyond the flange trap, the opening being sized so that the container bottom fits through the opening, the flange trap being positioned and sized to contact a bottom surface of the container flange;

the top cover having a seal boss, a top cover seal lock, a substantially planar flange boss, and a top surface, the top cover seal lock being disposed to align with and contact the base seal lock when the closure is in a closed position, the flange boss being located inside of the top cover seal lock and being disposed to align with the flange trap and contact the top surface of the container flange when the closure is in the closed position, the seal boss being located inside of the top cover seal lock and the flange boss and outside the top surface, the seal boss having an open V-shaped configuration defined by first and second members joined at an apex extending downwardly beyond the top surface and the flange boss such that the seal boss extends into the base and contacts the at least one side wall of the container when the lid is in the closed position; and a hinge connecting the base to the top cover and allowing the closure to exist in an open position or a closed position.

8. A closure for a container comprising:

a base having a substantially planar flange trap, a base seal lock, at least one base sidewall, and an opening, the flange trap having a generally horizontal orientation, the at least one base sidewall extending downwardly from the flange trap to the opening, the opening being defined inside of the flange trap, and the base seal lock extending beyond the flange trap; and a top cover having a seal boss, a top cover seal lock, a substantially planar flange boss, and a top surface, the top cover seal lock being disposed to align with and contact the base seal lock when the closure is in a closed position, the flange boss being located inside of the top cover seal lock and being disposed to align with the flange trap when the closure is in the closed position, the seal boss being located inside of the top cover seal lock and the flange boss and outside the top surface, the seal boss having an open V-shaped configuration defined by first and second members joined at an apex extending downwardly beyond the top surface and the flange boss such that the seal boss extends into the base to contact at least one sidewall of a container positioned in the base when the closure is in the closed position.

9. The closure of claim 8, further comprising a hinge connecting the base to the top cover and allowing the closure to exist in an open position or a closed position.

10. The closure of claim 9, wherein the closure comprises a polymer.

11. The closure of claim 10, wherein the closure comprises oriented polystyrene (OPS).

12. The closure of claim 9, wherein the closure comprises polyethylene terephthalate (PET).

13. The closure of claim 9, wherein the closure comprises polypropylene.

14. A method of using a closure for a container and a container combination, the method comprising providing a closure having a base, a top cover, and a hinge, the base having a substantially planar flange trap, a base seal lock, and an opening, the flange trap having a generally horizontal orientation, the opening being located inside of the flange trap, and the base seal lock extending beyond the flange trap, the top cover having a seal boss, a top cover seal lock, a substantially planar flange boss, and a top surface, the top cover seal lock being disposed to align with and contact the base seal lock when the closure is in a closed position, the flange boss being defined inside of the top cover seal lock and being disposed to align with the flange trap when the closure is in the closed position, the seal boss being located inside of the top cover seal lock and the flange boss and outside the top surface, the seal boss having an open V-shaped configuration defined by first and second members joined at an apex extending downwardly beyond the top surface and the flange boss such that the seal boss extends into the base and contacts at least one sidewall of a container positioned in the base when the closure is in the closed position, the hinge connecting the base to the top cover and allowing the closure to be moved between an open position and a closed position;

providing a container having a bottom, at least one side wall, and a substantially planar flange, the at least one side wall joining the bottom to the flange, the flange being generally horizontal and extending around a perimeter of the at least one side wall, the flange extending outwardly from the at least one side wall;

arranging the closure and the container such that the container bottom is within the opening of the closure base;

positioning the closure so that the flange trap of the closure base contacts the container flange;

moving the top cover of the closure about the hinge so that the flange boss of the top cover contacts the container flange and the seal boss is within the at least one sidewall of the container; and securing the top cover of the container to the base so that the top cover seal lock engages the base seal lock.

15. The closure of claim 1, wherein the seal boss contacts the at least one sidewall at a location below the flange trap when the closure is in the closed position.

16. The closure of claim 1, wherein the seal boss is configured to form a seal with the at least one sidewall.

17. The closure of claim 1, wherein the top surface of the closure is substantially aligned with the flange boss.

18. The closure of claim 1, wherein the closure is secured to the container only when the closure is in the closed position.

19. The method according to claim 14, wherein the seal boss contacts the at least one sidewall at a location below the flange trap when the closure is in the closed position.

20. The method according to claim 14, wherein the seal boss is configured to form a seal with the at least one sidewall.

21. The method according to claim 14, wherein the top surface of the closure is substantially aligned with the flange boss.

22. The method according to claim 14, wherein the closure is secured to the container only when the closure is in the closed position.

23. The closure of claim 1, wherein at least the top cover is made of a single sheet of material.

24. The closure and container of claim 7, wherein at least the top cover is made of a single sheet of material.

25. The closure of claim 8, wherein at least the top cover is made of a single sheet of material.

26. The method of claim 14, wherein at least the top cover is made of a single sheet of material.

* * * * *